US009938679B2

(12) United States Patent
Garant

(10) Patent No.: US 9,938,679 B2
(45) Date of Patent: Apr. 10, 2018

(54) DOCK INSTALLATION APPARATUS AND METHOD

(71) Applicant: Real Garant, Donnelly (CA)

(72) Inventor: Real Garant, Donnelly (CA)

( * ) Notice: Subject to any disclaimer, the term of this patent is extended or adjusted under 35 U.S.C. 154(b) by 252 days.

(21) Appl. No.: 14/614,719

(22) Filed: Feb. 5, 2015

(65) Prior Publication Data

US 2015/0218766 A1 Aug. 6, 2015

(30) Foreign Application Priority Data

Feb. 5, 2014 (CA) ..... 2841517

(51) Int. Cl.
*B63B 35/36* (2006.01)
*E01D 15/20* (2006.01)
*E02B 3/06* (2006.01)

(52) U.S. Cl.
CPC ..... *E02B 3/068* (2013.01); *Y10T 29/49819* (2015.01)

(58) Field of Classification Search
CPC ..... E01D 15/20; E01D 15/14; E02B 3/064; E02B 3/068; B63B 35/34; B63B 35/38; B63B 2737/00; B63B 35/36; B63C 1/02
USPC ..... 405/218–221
See application file for complete search history.

(56) References Cited

U.S. PATENT DOCUMENTS 1,358,951 A * 11/1920 Helmich ..... E02B 3/068 14/2.4
1,975,049 A * 9/1934 Middlebrook ..... E02B 3/068 405/221
2,306,311 A * 12/1942 Holland ..... E01D 15/133 14/2.4
2,948,121 A * 8/1960 Karst ..... E02B 3/068 405/220
3,043,109 A * 7/1962 Erickson ..... E02B 3/068 14/77.1
3,081,601 A * 3/1963 Fentiman ..... E02B 3/068 14/4
3,106,826 A * 10/1963 Freidel ..... E02B 3/068 14/69.5
3,176,470 A * 4/1965 Stiff ..... E02B 3/068 405/218
3,208,227 A * 9/1965 Armbrust ..... E02B 3/068 182/201
3,380,257 A * 4/1968 Gillman ..... E02B 3/068 182/145

(Continued)

*Primary Examiner* — Benjamin Fiorello
*Assistant Examiner* — Edwin Toledo-Duran
(74) *Attorney, Agent, or Firm* — Davis & Bujold PLLC; Michael J. Bujold

(57) ABSTRACT

A method of installing a dock includes providing first and second dock sections, each having a bottom transport member, and a dock support that supports the dock section when installed. The first dock section is installed adjacent to a shoreline. The dock lifting device of a dock cart is attached to the second dock section and the lifting device of the dock cart lifts the first end of the second dock section such that the second dock section is supported by the bottom transport member and the cart transport member. The cart moves the second dock section along the first dock section until the first end of the second dock section is adjacent to the second end of the first dock section. The lifting device then lowers the first end of the second dock section to be level with the second end of the first dock section.

23 Claims, 11 Drawing Sheets

(56) References Cited

U.S. PATENT DOCUMENTS 3,397,546 A * 8/1968 Eisert ..... B63B 9/00 14/2.4
3,492,825 A * 2/1970 Pearson ..... E01D 15/24 114/263
3,568,451 A * 3/1971 Gustin ..... E02B 3/068 248/157
3,572,045 A * 3/1971 Owen ..... E02B 3/068 114/219
3,686,876 A * 8/1972 Muschell ..... E02B 3/068 114/71
3,824,796 A * 7/1974 Nasby, Jr. ..... E02B 3/068 405/220
4,037,420 A * 7/1977 Wicks ..... E02B 3/068 405/218
4,126,006 A * 11/1978 Lewis ..... E02B 3/068 403/298
4,133,067 A * 1/1979 Bennett ..... E01D 15/24 14/71.3
4,398,849 A * 8/1983 Moran ..... E02B 3/068 114/267
4,505,619 A * 3/1985 Sargent ..... E02B 3/068 114/263
4,695,195 A 9/1987 Brande
4,948,300 A * 8/1990 Bateson ..... E02B 3/068 405/220
5,158,032 A 10/1992 Pitt
5,788,416 A 8/1998 Wolgamot
6,079,925 A * 6/2000 Morgan ..... E21B 19/14 414/22.57
6,098,564 A * 8/2000 Zeilinger ..... B63C 13/00 114/263
6,217,259 B1 4/2001 Godbersen
6,257,167 B1 * 7/2001 Joaquim ..... B60P 3/1033 114/344
6,602,022 B1 * 8/2003 Wilkins ..... B63C 3/02 114/263
6,695,559 B1 * 2/2004 Pietras ..... E21B 19/00 414/22.57
6,746,181 B1 * 6/2004 Heintz ..... E02B 3/068 114/263
7,241,078 B2 * 7/2007 Surges ..... E02B 3/06 14/75
7,794,178 B2 * 9/2010 Golden ..... E02B 3/068 114/263
8,292,547 B2 10/2012 Johanneck et al.
2006/0124356 A1 * 6/2006 Gust ..... E21B 19/14 175/52
2009/0016820 A1 1/2009 Baber et al.
2010/0296874 A1 * 11/2010 Woodhouse ..... E02C 3/00 405/219

* cited by examiner

DOCK INSTALLATION APPARATUS AND METHOD

TECHNICAL FIELD

This relates to a dock installation apparatus and method for a temporary dock structure.

BACKGROUND

It is often required to install and remove a dock for recreational or other purposes according to seasonal or other demands. Installing and removing a dock or dock sections can be a labour intensive process, and is often difficult to accomplish without a number of people in and out of the water. U.S. Pat. No. 4,948,300 is one example of a dock installation assembly.

SUMMARY

According to an aspect, there is provided a method of installing a dock, the method having the steps of providing a first dock section and a second dock section, with each dock section having a first end, a second end, a bottom transport member spaced from the first and second ends, and a dock support attached to the dock section, the dock support supporting the dock section when installed, as well as providing a cart, the cart having a first end having a cart transport member and a second end having a dock lifting device. The first dock section is installed adjacent to a shoreline. The dock lifting device is attached to the first end of the second dock section and the lifting device is activated to lift the first end of the second dock section such that the second dock section is supported by the bottom transport member and the cart transport member. The cart moves the second dock section along a top surface of the first dock section toward the second end of the first dock section until the first end of the second dock section is adjacent to the second end of the first dock section. The lifting device is then caused to lower the first end of the second dock section to be level with the second end of the first dock section, and the first end of the second dock section is supported by the second end of the first dock section.

According to another aspect, the method may have the further steps of providing a shore attachment point at the first end of the first dock section and attaching the shore attachment point to the shoreline.

According to another aspect, the bottom transport member may comprise a set of rollers.

According to another aspect, the cart transport member may comprise a set of rollers.

According to another aspect, the bottom transport member may be positioned at a balance point of the dock section.

According to another aspect, the dock section has a length and the balance point may be located ⅗ of the length from the first end of the dock section and ⅖ of the length from the second end of the dock section.

According to another aspect, the dock section may comprise a truss support structure.

According to another aspect, the cart may have guide members that engage the sides of the dock sections.

According to another aspect, the second end of the cart may rest on the first end of the second dock section such that the lifting device may also lift the second end of the cart and the first section of the cart may rest on the cart transport member.

According to another aspect, the dock support may be attached at the second end of the dock section and may engage the sides of the first dock section to act as a guide as the cart moves the second dock section along the top surface of the first dock section.

According to another aspect, the dock support may have support legs attached at the second end of the dock section that pivot between a stored position adjacent to the dock section and a support position extending downward from the dock section.

According to another aspect, the support legs may comprise wheels.

According to another aspect, the support legs may be adjustable in length.

According to another aspect, the method may further comprise the step of attaching a guide and support device to the second end of the first dock section to assist in moving the second dock section over the second end of the first dock section.

According to another aspect, when the bottom transport members reach the second end of the first dock section, the dock support may be pivoted to the support position.

According to another aspect, the method may further comprise removing the cart from the second dock section and attaching the cart to an additional dock section to be installed.

According to another aspect, the cart may comprise a winch that pulls the cart.

According to another aspect, the cart may comprise a motor for driving the cart transport members.

According to another aspect, the dock lifting mechanism may comprise a hand crank or a hand drill attachment.

According to an aspect, there is provided a method of removing a dock, the dock having a first dock section and a second dock section, each dock section having a first end, a second end, a bottom transport member spaced from the first and second ends, and a dock support attached to the dock section, the dock support supporting the dock section when installed. The method has the steps of providing a cart for manipulating dock sections, the cart comprising a first end having a cart transport member and a second end having a dock lifting device. The cart is placed adjacent to the first end of the second dock section and the second end of the first dock section. The lifting device is attached to the first end of the second dock section and activated to lift the first end of the second dock section, and the cart moves the second dock section along a top surface of the first dock section toward the first end of the first dock section. The bottom transport member of the second dock section is caused to engage the top surface of the first dock section such that the second dock section is supported by the bottom transport member and the cart transport member.

According to another aspect, the method may have the further step of removing the second dock section, releasing an attachment of the first dock section to a shoreline, and removing the first dock section.

According to another aspect, the method may have the further step of providing a shore attachment point to the first end of the first dock section and attaching the shore attachment point to the shoreline.

According to another aspect, the bottom transport member may comprise a set of rollers.

According to another aspect, the cart transport member may comprise a set of rollers.

According to another aspect, the bottom transport member may be positioned at a balance point of the dock section.

According to another aspect, the balance point may occur at 3/5 from the first end of the dock section and 2/5 from the second end of the dock section.

According to another aspect, the dock section may comprise a truss support structure.

According to another aspect, the cart may comprise engagement members that may engage the sides of the dock sections.

According to another aspect, the second end of the cart may rest on the first end of the second dock section such that the lifting device may also lift the second end of the cart, the first section of the cart may rest on the cart transport member.

According to another aspect, the dock support may be attached to the second end of the dock section and may be spaced to engage the sides of a previously installed dock section to act as a guide.

According to another aspect, the dock support may comprise support legs attached at the second end of the dock section that may pivot between a stored position adjacent to the dock section and a support position extending downward from the dock section.

According to another aspect, the support legs may comprise wheels.

According to another aspect, the support legs may be adjustable in length.

According to another aspect, the method may further comprise the step of attaching a guide and support device to the second end of the first dock section to assist in moving the second dock section over the second end of the first dock section.

According to another aspect, when the bottom transport members reach the second end of the first dock section, the support legs may be pivoted to the stored position adjacent to the dock section.

According to another aspect, the method may further comprise removing the cart from the second dock section and attaching the cart to an additional dock section to be removed.

According to another aspect, the cart may comprise a winch that pulls the cart.

According to another aspect, the cart may comprise a motor for driving the cart transport members.

According to another aspect the dock lifting mechanism may comprise a hand crank or a hand drill attachment.

According to an aspect, there is provided a combination of a first dock section and a second dock section, each dock section having a first end, a second end, a bottom transport member spaced from the first and second ends and a dock support attached to the dock section, the dock support supporting the dock section when installed, and a cart having a cart body with a first end and a second end, each of the first end and the second end having a dock engaging member, a cart transport member at the first end of the cart body, and a dock lifting mechanism being spaced between the first end and the second end and adjacent to the second end, the dock lifting mechanism having an attachment that attaches to a dock section such that when in use the cart engages a first and second dock section, the first end of the cart resting on the first dock section and the second end of the cart resting on the second dock section, the dock lifting mechanism applies a lifting force to the second dock section and causes the cart body to pivot about the first end of the cart body as it raises the first end of the second dock section, the second end of the cart being lifted with the first end of the second dock section.

According to another aspect, the first dock section may have a shore attachment point at the first end of the first dock section.

According to another aspect, the bottom transport member may comprise a set of rollers.

According to another aspect, the cart transport member may comprise a set of rollers.

According to another aspect, the bottom transport member may be positioned at a balance point of the dock section.

According to another aspect, the balance point may occur at 3/5 from the first end of the dock section and 2/5 from the second end of the dock section.

According to another aspect, the dock section may comprise a truss support structure.

According to another aspect, the cart may comprise engagement members that engage the sides of the dock sections.

According to another aspect, the dock support may attached to the second end of the dock section and may be spaced to engage the sides of a previously installed dock section to act as a guide.

According to another aspect, the dock support may have support legs attached at the second end of the dock section that pivot between a stored position adjacent to the dock section and a support position extending downward from the dock section.

According to another aspect, the support legs may comprise wheels.

According to another aspect, the support legs may be adjustable in length.

According to another aspect, the adjustable legs may be adjusted with a hand crank on the scathe of the dock section.

According to another aspect, when the bottom transport members reach the second end of the first dock section, the support legs may be pivoted to the support position.

According to another aspect, the cart may comprise a winch that pulls the cart.

According to another aspect, the cart may comprise a motor for driving the cart transport members.

According to another aspect, the dock lifting mechanism may comprise a hand crank.

According to an aspect, there is provided a cart for installing and removing a dock section. The cart has a cart body having a first end comprising a cart transport member and a second end comprising a dock contact member, and a dock lifting mechanism carried by the cart body toward the second end, the dock lifting mechanism having an attachment that attaches to a dock section, the dock lifting mechanism selectively raising and lowering the dock section. In use the cart transport member rests on a first dock section and the dock contact member rests on a second dock section, and the dock lifting mechanism attaches to the second dock section and applies a lifting force to the second dock section such that the cart body pivots about the cart transport member and the second dock section moves vertically relative to the first dock section.

According to another aspect, the cart transport member may comprise a set of rollers.

According to another aspect, the cart may comprise cart guide members that may engage the sides of the first and second dock sections.

According to another aspect, the cart may comprise a winch that pulls the cart.

According to another aspect, the cart may comprise a motor for driving the cart transport members.

According to another aspect, the dock lifting mechanism may comprise a hand crank.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
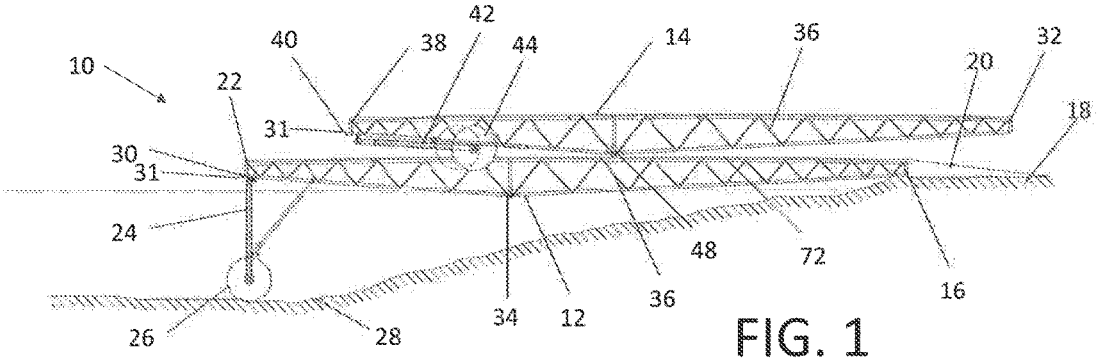
FIG. 1 is a side elevation view of a dock with a second section being rolled onto a first section.

A dock assembly generally identified by reference numeral 10, will now be described with reference to FIG. 1 through 18.

Structure and Relationship of Parts:

Referring to FIG. 1, dock assembly 10 is shown as having a first section 12 and a second section 14. Other sections may be attached in the manner discussed below, in a preferred embodiment, dock sections 12 and 14 are constructed with a truss support structure 36 although other dock designs may also be used.

First dock section 12 has a first end 16 and a second end 22. First end 16 is installed adjacent to a shoreline 18 and in a preferred embodiment, carries a shore attachment point 20 used to anchor the first section 12 to the shoreline 18. Shore attachment point 20 provides access to dock assembly 10 while maintaining its position as forces are applied to dock assembly 10 during use. It will be understood that various types of anchors or attachments may be used for this purpose as will be recognized in the art. For example, attachment point 20 may be include an attachment between first section 12 and posts or other permanent anchors that are fixed to the shoreline 18, or may be an anchor that. Second end 22 of first section 12 is designed to extend out onto the body of water, in the depicted embodiment, second end 22 has support legs 24 with wheels 26 that contact the bed 28 of the body of water. It may be possible to adapt the teachings herein to a floating dock with floatation devices, or dock sections 12 and 14 may be supported on posts set on the bed of the body of water. While various methods of support may be used to support a dock, as will be understood by one skilled in the art, the example that is depicted and described uses support legs 24 with wheels as this facilitates the installation and removal of sections 12 and 14.

First section 12 has a bottom transport member 34 provided between first end 16 and second end 22. In a preferred embodiment bottom transport member 34 is a set of rollers. However, bottom transport member 34 may also be another transport device such as a skid or other low friction surface. Bottom transport member 34 is preferably positioned at a balance point of the first dock section 12. In the depicted example, this balance point occurs at a point approximately ⅗ of the length of the first dock section 12 toward the second end 22 to account for the additional weight of support legs 24.

Figure 7:
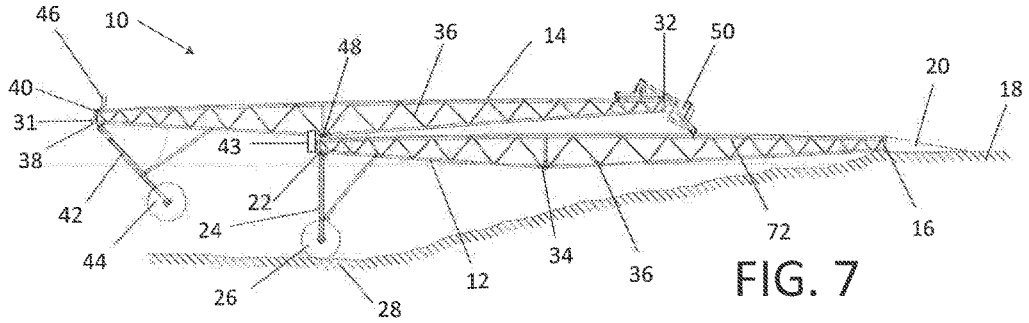
FIG. 7 is a side elevation view of a dock with the support legs being pivoted downward.

Second end 22 has an attachment point 30 intended to attach to second dock section 14. Various attachments may be used as will be recognized. In one example, attachment point 30 uses brackets 31 shaped to receive first end 32 of second dock section 14. Brackets 31 may receive and hold second section 14, or may simply be used as a support and guide while additional attachments, such as bolls or clamps, are attached to secure first and section sections 12 and 14. Attachment point 30 may be a two-part connection that mates with a corresponding connection section on second section 14. Second section 14 is constructed also has a second end 38 constructed in a similar manner to first section 12, and in a preferred embodiment has an attachment point 40 at second end 38 provided to attach to an additional dock section that is the same as second section 14 should additional dock sections be required. As with first section 12, second section 14 preferably has support legs 42 with wheels 44 that contact the bed 28 of the body of water when the second section 14 is installed. The support legs 42 of second section 14, as well as the support legs 24 of first section 12, are preferably attached at the respective second ends 38 and 22 and are capable of pivoting between a stored position adjacent to the dock section and a support position where they extend downward to contact the bed 28 of the body of water. The support legs 42 and 24 may be adjustable in length to level the dock section and account for differences in the depth of the bed 28 of the body of water. Referring to FIG. 7, the length of support legs 24 and 42 may be adjusted using a rotary adjustment, such as a threaded rod rotated by a drill or a hand crank 46 to provide these different lengths. Other adjustment methods may also be used, such as an attachment for a hand drill or other driver. Referring back to FIG. 1, second section 14 also has a bottom transport member 48, as described above for bottom transport member 34. Support legs 24 and 42 preferably have wheels 26 and 44 as depicted to assist with the installation. Wheels 26 and 44 are spaced apart at a distance that is slightly larger than the width of dock sections 12 and 14. This allows them to act as a guide as one dock sections is moved along the top of another dock section.

Figure 2:
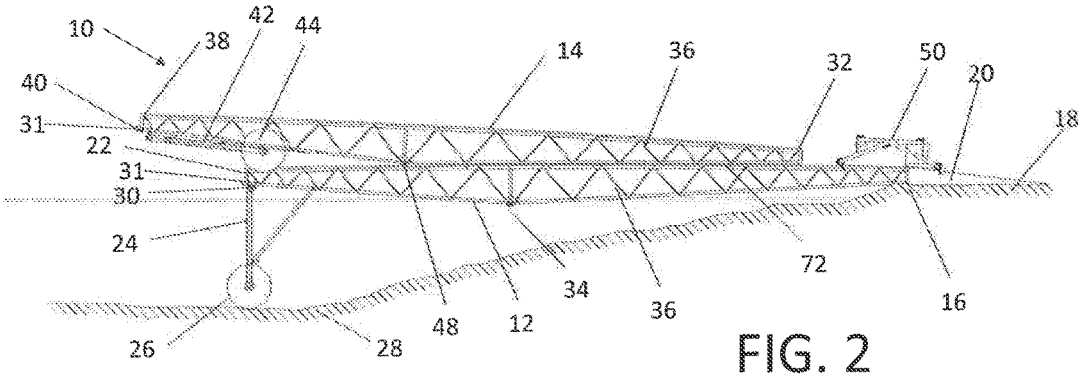
FIG. 2 is a side elevation view of a dock with a second section rolled along a first section and a cart.
Figure 14:
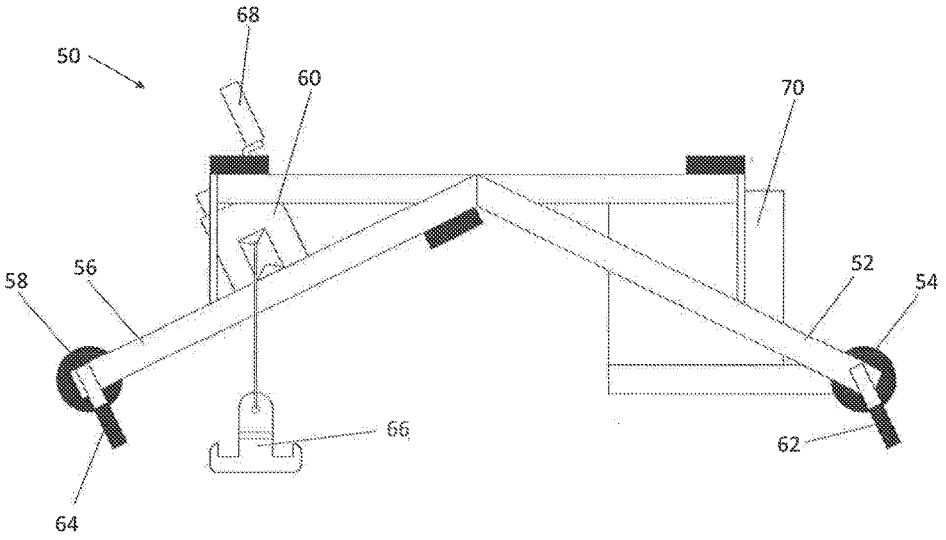
FIG. 14 is a side elevation view of a cart.

Referring to FIG. 2, the assembly of dock sections 12 and 14 may be assisted using a cart 50. Referring to FIG. 14, cart 50 has a cart transport member 54 at a first end 52, which is preferably a set of rollers as depicted but may be any transport device known in the art. First end 52 may also have guide members 62 spaced to engage the sides of the dock sections 12 and 14. Cart 50 may also have a dock contact member 58 and guide members 64 at a second end 56, similar to cart transport member 54 and guide members 62. When used in combination with wheels 44 in the storage position, dock section 14 is guided at two points, which ensures that it will be properly aligned until wheels 44 extend past second end 22 of first dock section 12, at which point second end 38 of dock section 14 will need to be guided manually. Second end 56 also has a dock lifting device 60. Dock lifting mechanism 60 has an attachment device 66 shaped to attach to second dock section 14. As depicted, the attachment device 66 is a hook that is designed to engage trusses 36, but other attachments may also be used. Dock lifting mechanism 60 is used to lift second dock section 14. Dock lifting mechanism 60 may take various forms, such as a motor driven lifting device. In the depicted embodiment, dock lifting mechanism 60 is a hand crank mechanism 68. Cart 50 may also have a device 70 for moving the cart 50. The device 70 for moving the cart 50 may take various forms. For example, the device 70 may be a winch, such as a capstan winch, that can pull the cart as it carries second dock section 14. Device 70 may also be a motor that drives the cart transport member 54, pushing the cart as it carries second dock section 14. Cart 50 may also be manually operated and may not have a device 70.

Installation

Figure 3:
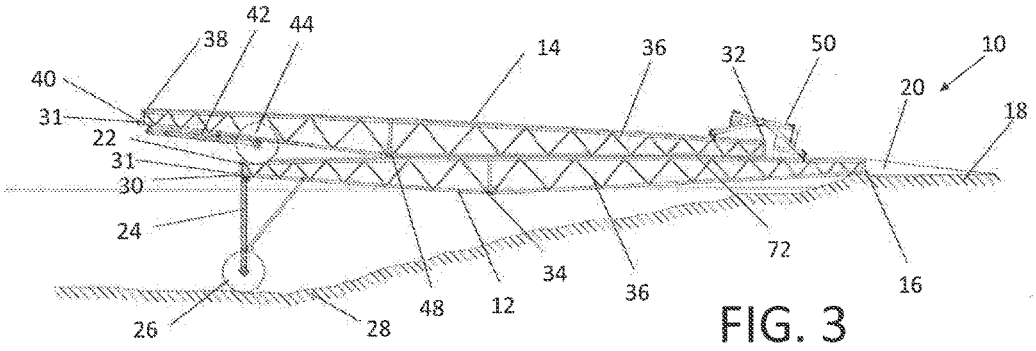
FIG. 3 is a side elevation view of a dock with a cart positioned on the first and second sections.
Figure 4:
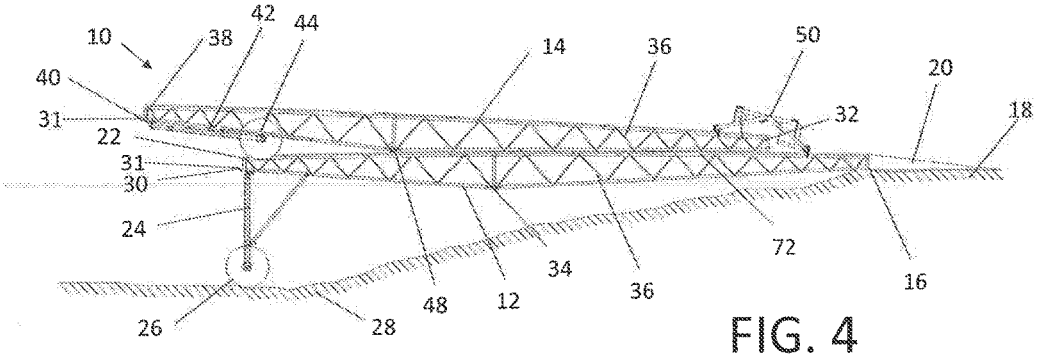
FIG. 4 is a side elevation view of a dock with a cart attaching to the first section.
Figure 5:
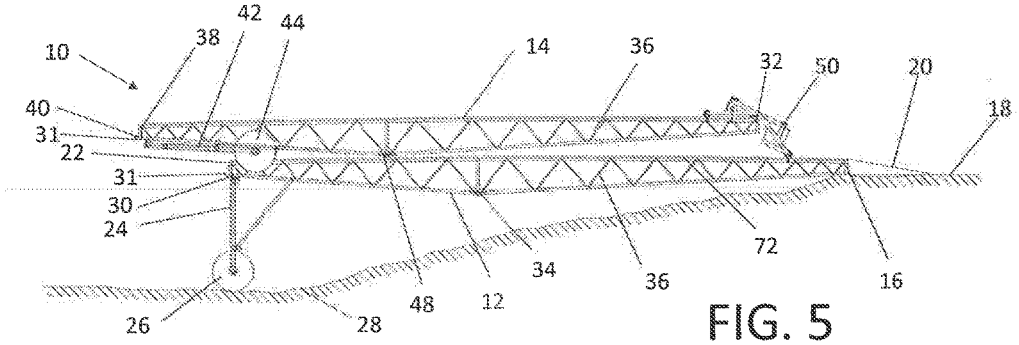
FIG. 5 is a side elevation view of a dock with a cart lifting the second section.
Figure 6:
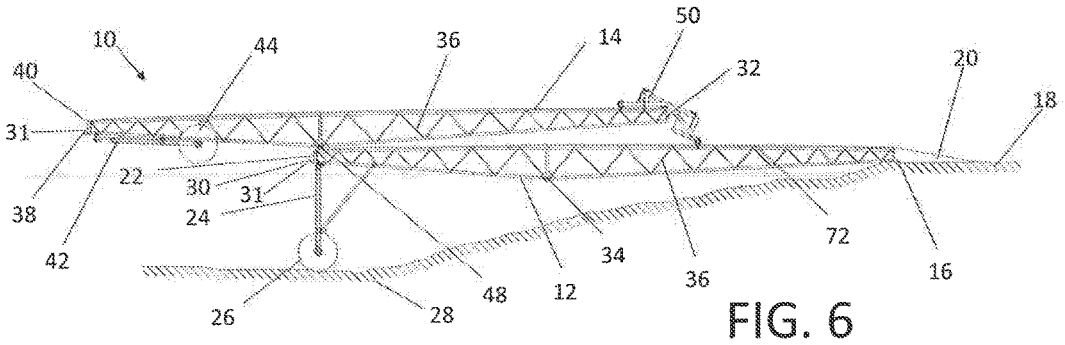
FIG. 6 is a side elevation view of a dock with a cart moving the second section toward the water.
Figure 8:
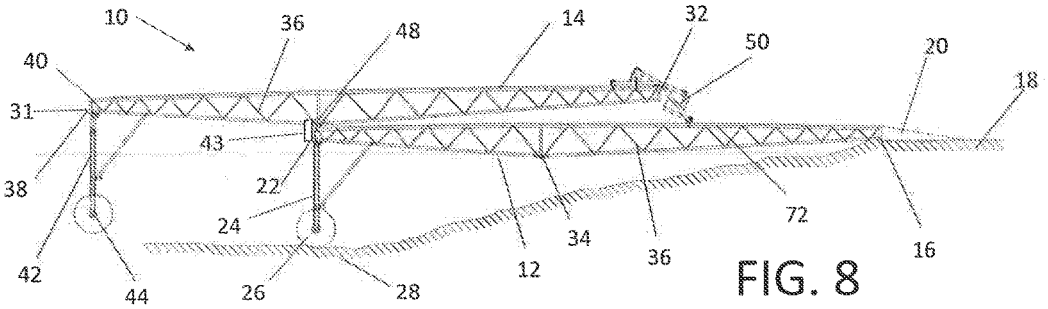
FIG. 8 is a side elevation view of a clock with the support legs in the support position.
Figure 9:
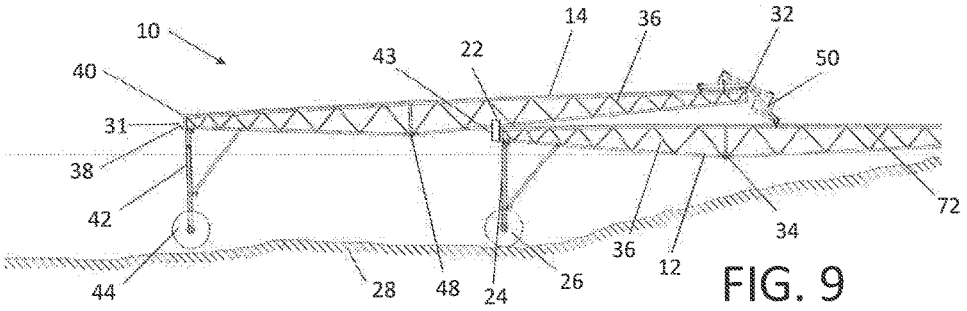
FIG. 9 is a side elevation view of a dock being moved into the water.
Figure 10:
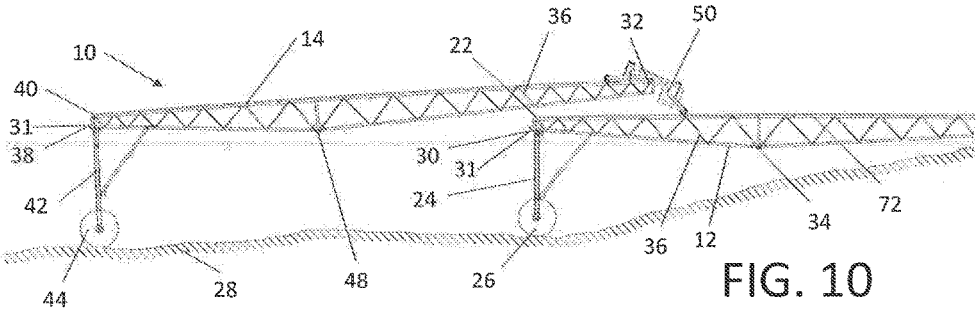
FIG. 10 is a side elevation view of a dock with the support legs reaching the bed of the body of water.
Figure 11:
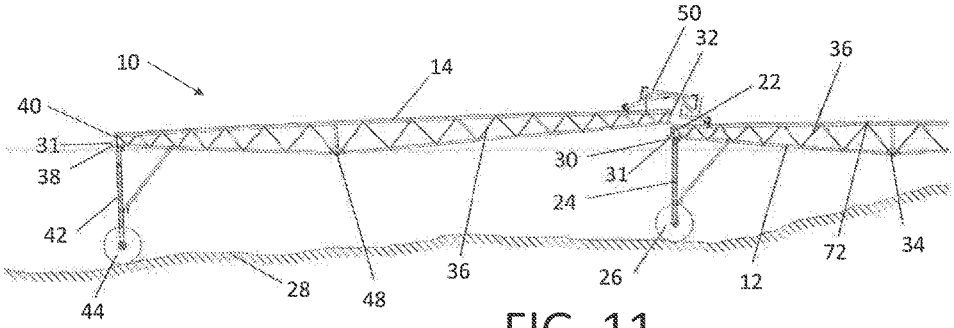
FIG. 11 is a side elevation view of a dock with the cart lowering the second dock section.
Figure 12:
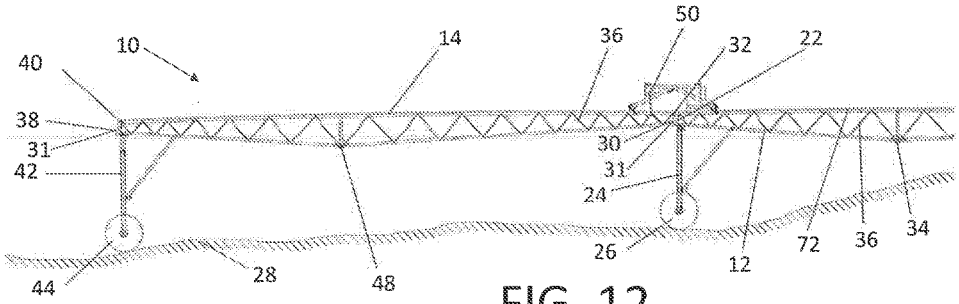
FIG. 12 is a side elevation view of a dock with the first and second dock sections being attached together.
Figure 13:
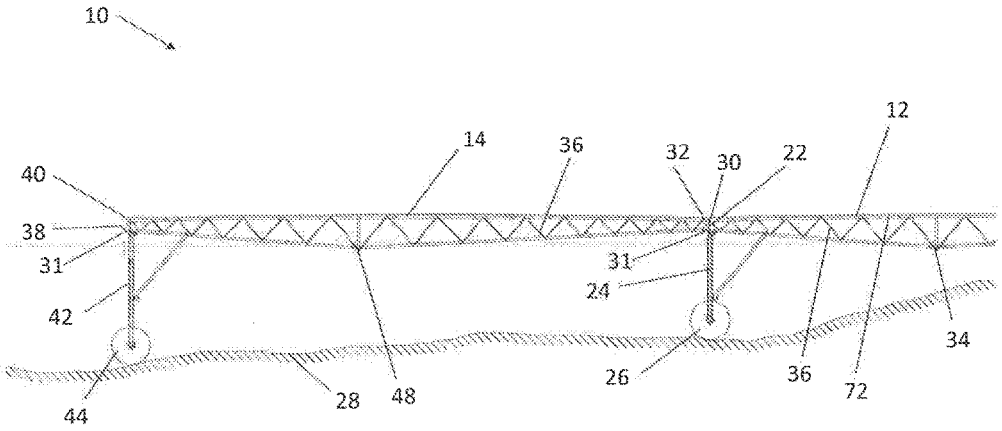
FIG. 13 is a side elevation view of a dock that has been installed.
Figure 15:
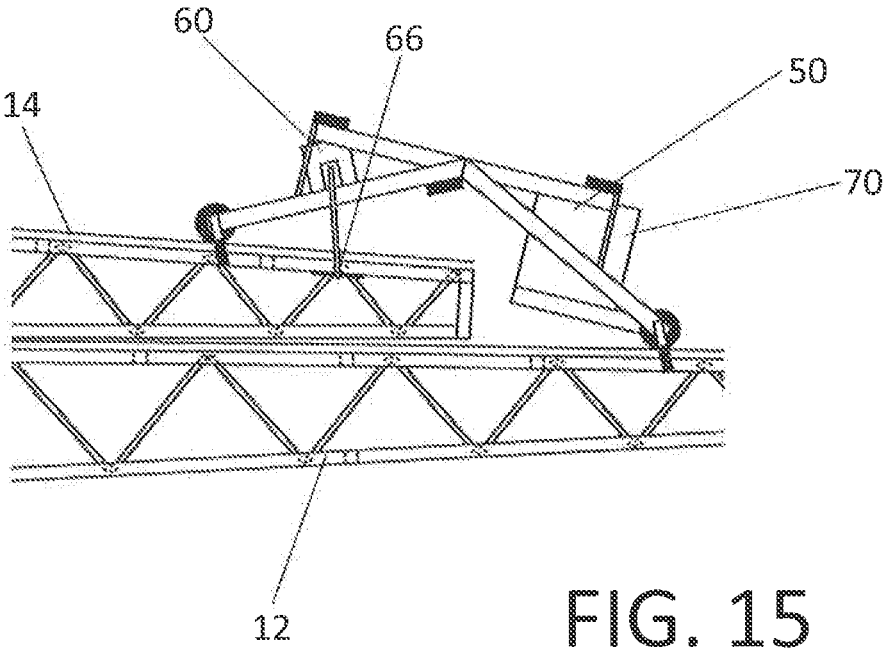
FIG. 15 is a side elevation view of a cart attaching to a second section of a dock.
Figure 16:
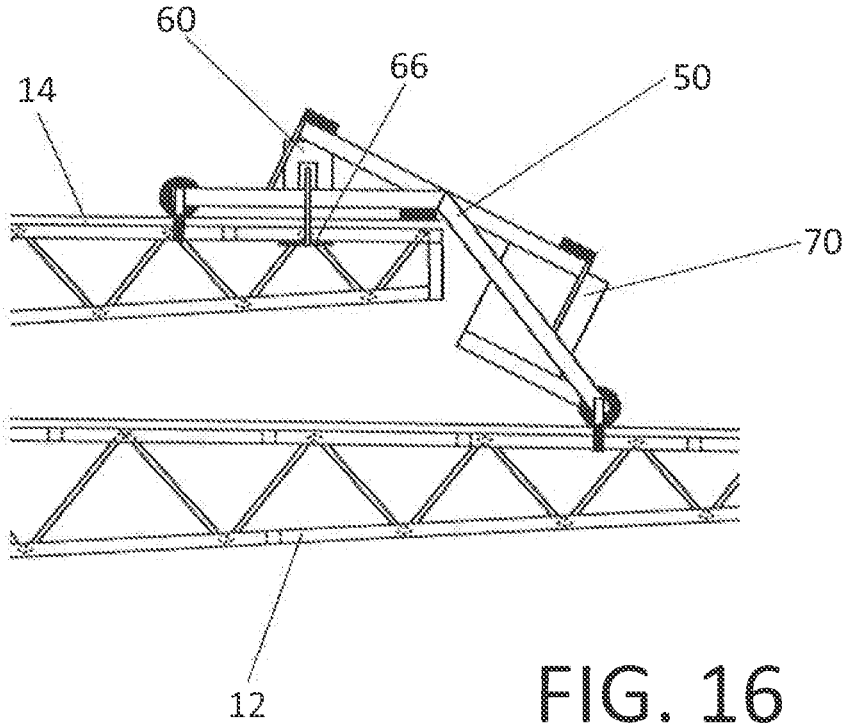
FIG. 16 is a side elevation view of a cart lifting a second section of a dock.
Figure 17:
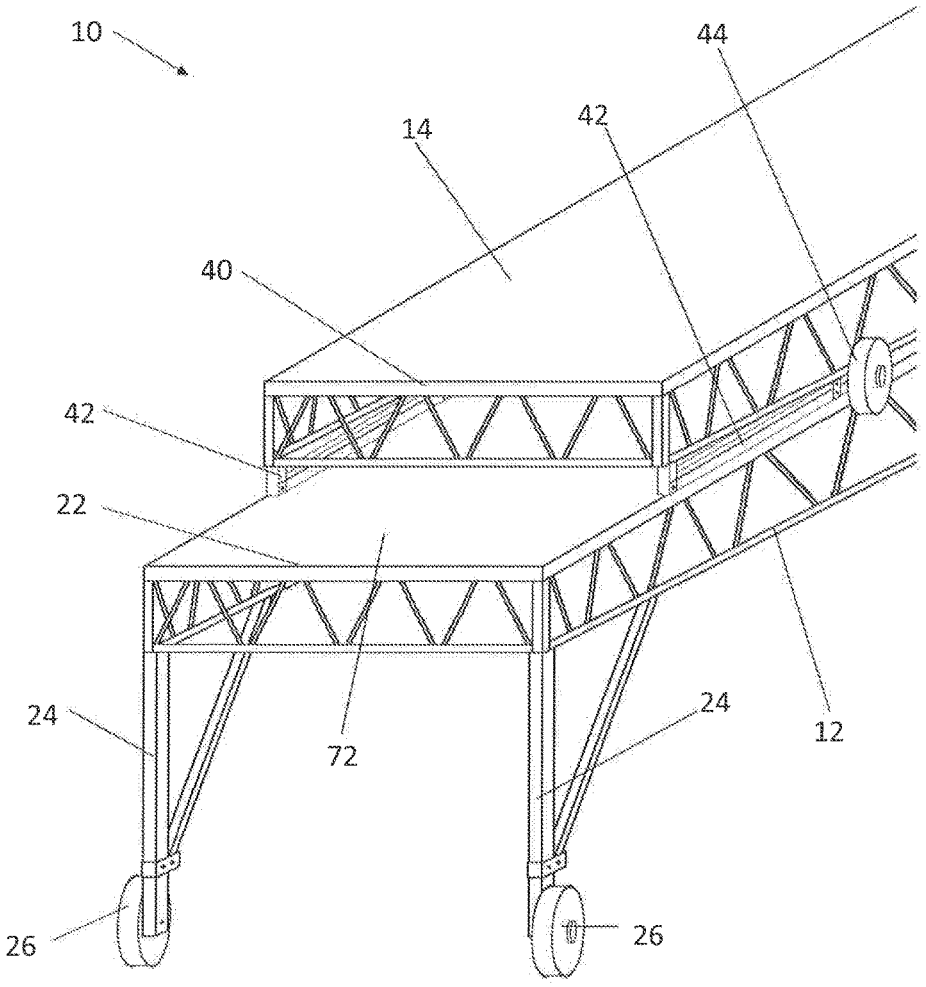
FIG. 17 is a perspective view of a first section of a dock with a second section of a dock resting on top.
Figure 18:
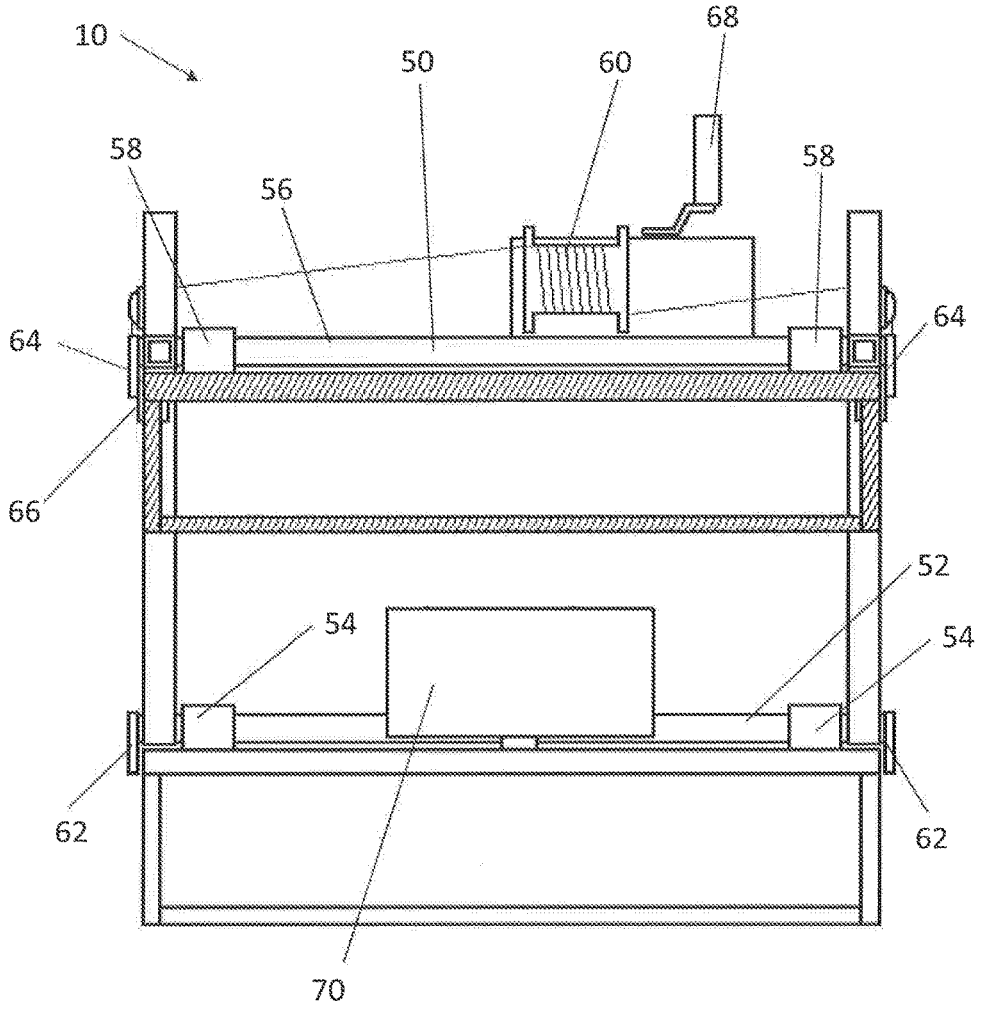
FIG. 18 is a front cross section view of a cart resting on a first section of a dock and lifting a second section.

The installation process of the depicted embodiment will now be described. Referring to FIG. 1, in order to install dock assembly 10, the first dock section 12 is placed into the water and attached to a shoreline 18. First dock section 12 will generally be manipulated manually using wheels 26. Once positioned, the height of support legs 24 is adjusted to level first section 12, with wheels 26 resting on the bed 28 of the body of water. Second dock section 14 is then moved onto first dock section 12 using bottom transport member 48, and guiding the movement with wheels 44, which preferably engage the sides of the first dock section 12 as shown in FIG. 17. Referring to FIG. 2, cart. 50 is then moved onto first dock section 12, and referring to FIG. 3, the cart 50 is positioned such that the cart transport member 54 rests on the first dock section 12 and the dock contact member 58 rests on the second dock section 14. Referring to FIG. 4, dock lifting mechanism 60 is attached to the second dock section 14 using attachment device 66. Referring to FIG. 5, dock lifting mechanism 60 is activated to apply a lifting force to the second dock section 14. This results in the cart 50 pivoting about the cart transport member 54 and the first end 32 of the second dock section 14 moves vertically relative to the first dock section 12, as shown in FIG. 15 and FIG. 16. This movement results in bottom transport member 48 becoming a balance point, such that the second dock section 14 is supported by the bottom transport member 48 and the cart transport member 54 while being guided by wheels 26 and guide members 62, while first end 32 of second dock section 14 is secured by guide members 64. Referring to FIG. 6, cart 50 is then used to move the second section 14 along the top surface 72 of the first dock section 12 to the point at which bottom transport member 48 reaches the second end 22 of first dock section 12. The respective positions of first section 12, second section 14, and cart 50 are further shown in FIG. 18. Referring to FIG. 7, at this point support leg 42 is preferably pivoted from the stored position adjacent to the dock section 14 to a support position extending downward from the dock section 14, as shown in FIG. 8. A guide and support device 43 may be positioned at second end 22 of first dock section 12. Preferably, guide and support device 43 includes rollers that support second dock section 14 in order to protect second end 22 of first dock section 12 as well as the underside of second dock section 14, if necessary. Guide and support device 43 also preferably has side flanges or guides that engage the sides of second dock section 14 to provide the function of wheels 44 when they no longer engage second dock section 14. Guide and support device 43 may be removed once wheels 44 engage the bed 28 of the body of water and can therefore support and help guide second dock section 14. Referring to FIG. 7, support leg 42 may be adjusted in length using hand crank 46 such that wheels 44 will be able to engage the bed 28 of the body of water. Referring to FIG. 9, second dock section 14 may then be further moved into the water until the wheels 44 reach the bed 28 of the body of water as shown in FIG. 10. Referring to FIG. 11, the second dock section 14 is then positioned such that the first end 32 of the second dock section 14 is adjacent to the second end 22 of the first dock section 12. Dock lifting mechanism 60 is then activated to lower second dock section 14. Referring to FIG. 12, second dock section 14 is lowered until the second section 14 can be attached to the first section 12 using attachment point 30. At this point the first end 32 of the second dock section 14 is level with the second end 22 of the first dock section 12. Referring to FIG. 13, the two dock sections 12 and 14 are then attached together and installation is complete. This process may them be repeated to install further dock sections to make dock assembly 10 longer. For any additional dock sections cart 50 would be removed from the second dock section 14 and attached to an additional dock section, which would be installed in the same manner as discussed for second dock section 14.

Removal

Referring to FIG. 13, an installed dock has at least two dock sections. As shown, dock assembly 10 has a first dock section 12 and a section dock section 14. It will be understood that dock assembly 10 may have more than two dock sections, and that the removal process as described would apply to dock assemblies 10 with more than two dock sections, in order to remove dock assembly 10 from the water, cart 50 is placed on dock assembly 10 such that it is adjacent to the first end 32 of the second dock section 14 and the second end 22 of the first dock section 12, and further such that such that the cart transport member 54 rests on the first dock section 12 and the dock contact member 58 rests on the second dock section 14. Referring to FIG. 12, dock lifting mechanism 60 of cart 50 is attached to the second dock section 14 using attachment device 66. Referring to FIG. 11, the attachment between first dock section 12 and second dock section 14 is then released at attachment point 30. Referring to FIG. 10, dock lifting mechanism 60 is then activated to lift the first end 32 of second dock section 14 by applying a lifting force to the first end 32. This results in the cart 50 pivoting about the cart transport member 54 and the first end 32 of the second dock section 14 moves vertically relative to the first dock section 12, as shown in FIG. 15 and FIG. 16. Second dock section 14 may then be moved towards the first end 16 of first dock section 12 using cart 50. Referring to FIG. 9, as second section 14 is moved, at some point the wheels 44 will no longer reach the bed 28 of the body of water. At this point second dock section 14 moves slidingly along first dock section 12 until bottom transport member 48 engages the top surface 72 of the first dock section 12 at the second end 22 of first dock section 12, as shown in FIG. 8. Preferably, guide and support device 43 is attached in order to guide second dock section 14 and protect both first and second dock sections 12 and 14. Once withdrawn sufficiently, the second dock section 14 is supported by the bottom transport member 48 and the cart transport member 54, and bottom transport member 48 becomes a balance point. The respective positions of first section 12, second section 14, and cart 50 are further shown in FIG. 18. Referring to FIG. 7, the support leg 42 can then be pivoted from the support position extending downward from the dock section 14 to the stored position adjacent to the dock section 14 as shown in FIG. 6. The length of support leg 42 may be reduced using hand crank 46 as shown in FIG. 7, however it is preferable to leave the length of support legs 42, as this will simplify re-installation in the next season. When in the stored position, wheels 44 preferably engage the sides of the first dock section 12 as shown in FIG. 17, and guide the movement of second dock section 14 along first dock section 12. Referring to FIG. 5, cart 50 is then used to move the second section 14 along the top surface 72 of the first dock section 12. Referring to FIG. 4, when the second dock section 14 has moved sufficiently far along first dock section 12 that the user no longer desires to use the cart, dock lifting mechanism 60 is activated to lower second dock section 14 to the surface 72 of first dock section 12. Referring to FIG. 3, dock lifting mechanism 60 is then removed from the second dock section by releasing attachment device 66. Referring to FIG. 2, the cart 50 can then be removed from the first dock section 12. Referring to FIG. 1, the second dock section 14 can then be moved off of first dock section 12. At this point, wheels 44 may be used to transport second dock section 14, as bottom transport members 48 are smaller and primarily for use in transporting dock section 14 across the decking of first dock section 12. In order to remove first dock section 12 from the water it is released from the shoreline 18 using attachment point 20 at first end 16. Support, legs 24 may be adjusted in length or pivoted to a stored position as with second dock section 14. First dock section 12 can then be removed from the water using wheels 26. Support legs 24 may or may not be folded to the transportation position. As can be seen, first dock section 12 has been manufactured to be the same as section dock section 14 for ease of manufacturing and to allow dock sections to be exchanged if necessary. However, it will be understood that certain features and elements, such as 34, may not be necessary for first dock section 12.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A method of installing a dock in a body of water, the method comprising the steps of:

providing a first dock section and a second dock section, each dock section comprising:

a first end;

a second end;

a bottom surface;

a top surface above the bottom surface;

a bottom transport member on the bottom surface spaced from the first and the second ends; and a dock support attached to the second end the dock section, and the dock support supporting the dock section when installed;

providing a cart, the cart comprising a first end having a cart transport member and a second end having a dock lifting device;

installing the first dock section adjacent to a shoreline with the top surface located above the bottom surface;

attaching the dock lifting device to the first end of the second dock section and activating the lifting device to lift the first end of the second dock section such that the second dock section is supported by the bottom transport member and the cart transport member at a point spaced from the bottom transport member along the first dock section;

having the cart move the second dock section along a top surface of the first dock section toward the second end of the first dock section with the second end of the second dock section leading the first end and the top surface above the bottom surface until the bottom transport member supports the second dock section above the first dock section, and the second end of the second dock section extends past the second end of the first dock section;

continuing to move the second dock section along the top surface of the first dock section such that the dock support extends away from the second dock section and toward a bed of the body of water;

with the dock support extended, moving the second dock section until the first end of the second dock section is adjacent to the second end of the first dock section and the dock support supports the second end of the second dock section;

causing the lifting device to lower the first end of the second dock section to be level with the second end of the first dock section; and engaging the first end of the second dock section and the second end of the first dock section such that the second end of the first dock section supports the first end of the second dock section.

2. The method of claim 1, further comprising the steps of providing a shore attachment point at the first end of the first dock section and attaching the shore attachment point to the shoreline.

3. The method of claim 1, wherein the bottom transport member is positioned at a balance point of the dock section.

4. The method of claim 3, wherein the dock section has a length and the balance point is located ⅗ of the length from the first end of the dock section and ⅖ of the length from the second end of the dock section.

5. The method of claim 1, wherein the cart and the dock support, in a nonextended position, each comprise guide members that engage opposed sides of the first dock section at a point below the top surface as the second dock section moves along the first dock section.

6. The method of claim 1, wherein the second end of the cart rests on the first end of the second dock section such that the lifting device simultaneously lifts the first end of the second dock section and the second end of the cart, and the first section of the cart rests on the cart transport member, the lifting device being spaced from each of the first end and the second end of the cart, such that the second end of the cart extends past the lifting device.

7. The method of claim 1, wherein the dock support is attached at the second end of the dock section and engages the sides of the first dock section to act as a guide as the cart moves the second dock section along the top surface of the first dock section.

8. The method of claim 1, wherein the dock support comprises support legs attached at the second end of the dock section that pivot between a stored position adjacent to the dock section and a support position extending downward from the dock section.

9. The method of claim 8, further comprising attaching a guide and support device to the second end of the first dock section to assist in moving the second dock section over the second end of the first dock section.

10. The method of claim 8, wherein when the bottom transport members reach the second end of the first dock section, the dock support is pivoted to the support position.

11. The method of claim 1, wherein the cart comprises a winch that pulls the cart.

12. A method of removing a dock, the dock comprising a first dock section and a second dock section, each dock section comprising a first end, a second end, a bottom surface, a top surface above the bottom surface, a bottom transport member on the bottom surface spaced from the first and the second ends, and a dock support attached to the dock section, the dock support supporting the dock section when installed, the method comprising the steps of:

providing a cart for manipulating dock sections, the cart comprising a first end having a cart transport member and a second end having a dock lifting device;

placing the cart on the top surface of the first and the second dock sections and adjacent to the first end of the second dock section and the second end of the first dock section, and the first end of the second dock section being engaged with the second end of the first dock section;

attaching the lifting device to the first end of the second dock section;

activating the lifting device to lift the first end of the second dock section relative to the second end of the first dock section;

having the cart move the second dock section along a top surface of the first dock section toward the first end of the first dock section, the first end of the second dock section leading the second end and the top surface being above the bottom surface as the second dock section moves;

causing the bottom transport member of the second dock section to engage the top surface of the first dock section such that the second dock section is supported by the bottom transport member and the cart transport member; and with the bottom transport member on the top surface of the first dock section and the second end of the second dock section extending past the second end of the first dock section, retracting the dock support from a support position to a transport position.

13. A dock installation system, comprising:

a first dock section and a second dock section, each dock section comprising a first end, a second end, a bottom surface, a top surface above and opposite the bottom surface, a bottom transport member spaced from the first and the second ends and a dock support attached to the dock section, the dock support supporting the dock section when installed; and a cart comprising:

a cart body having a first end and a second end, each of the first end and the second end having a dock engaging member;

a cart transport member at the first end of the cart body; and a dock lifting mechanism being spaced between the first end and the second end and adjacent to the second end, the dock lifting mechanism having an attachment that attaches to a dock section such that:

when in use the cart engages first and second dock sections, the first end of the cart resting on the first dock section and the second end of the cart resting on the top surface of the second dock section;

the dock lifting mechanism applies a lifting force to the second dock section and causes the cart body to pivot about the first end of the cart body as it raises the first end of the second dock section such that the second end of the cart is simultaneously lifted with the first end of the second dock section.

14. The dock installation system of claim 13, wherein the first dock section comprises a shore attachment point at the first end of the first dock section.

15. The dock installation system of claim 13, wherein the bottom transport member is positioned at a balance point of the dock section.

16. The dock installation system of claim 15, wherein the balance point occurs at ⅗ from the first end of the dock section and ⅖ from the second end of the dock section.

17. The dock installation system of claim 13, wherein the cart comprises engagement members that engage the sides of the dock sections.

18. The dock installation system of claim 13, wherein the dock support is attached to the second end of the dock section and is spaced to engage the sides of a previously installed dock section to act as a guide.

19. The dock installation system of claim 13, wherein the dock support comprises support legs attached at the second end of the dock section that pivot between a stored position adjacent to the dock section and a support position extending downward from the dock section.

20. The dock installation system of claim 19, wherein when the bottom transport members reach the second end of the first dock section, the support legs are pivoted to the support position.

21. The dock installation system of claim 13, further comprising a guide and support device that is selectively attached to the second end of the first dock section to assist in moving the second dock section over the second end of the first dock section.

22. The dock installation system of claim 13, wherein the cart comprises a winch that pulls the cart.

23. The dock installation system of claim 13, wherein the cart and the dock support in an nonextended position each comprise comprises guide members that engage opposed sides of the first dock section dock sections at a point below the top surface as the second dock section moves along the first dock section.

* * * * *